US005183179A

United States Patent [19]

Morris, Sr.

[11] Patent Number: 5,183,179

[45] Date of Patent: Feb. 2, 1993

[54] CHILD DROWNING PROTECTING GUARD FOR AN OPEN HEAD NESTABLE CONTAINER

[76] Inventor: Glenn H. Morris, Sr., 1192 Cumberland Rd., Chattanooga, Tenn. 37419

[21] Appl. No.: 937,555

[22] Filed: Aug. 31, 1992

[51] Int. Cl.[5] ..... A65D 3/00

[52] U.S. Cl. ..... 220/694; 220/729; 220/890

[58] Field of Search ..... 220/694, 729, 600, 890

[56] References Cited

U.S. PATENT DOCUMENTS

| | | | |
|---|---|---|---|
| 55,145 | 5/1966 | Moore . | |
| 59,687 | 11/1966 | Waldstein et al. . | |
| 1,950,908 | 3/1934 | Stone et al. . | |
| 2,613,010 | 10/1952 | Atkinson . | |
| 3,001,642 | 9/1961 | Hirst . | |
| 3,402,844 | 9/1968 | Chin | 220/694 |
| 3,587,904 | 6/1971 | Harris et al. . | |
| 3,973,693 | 8/1976 | Brocklehurst . | |
| 4,113,094 | 9/1978 | Collin . | |
| 4,653,669 | 3/1987 | Holdt | 220/694 |
| 4,947,998 | 8/1990 | Smeller | 220/684 |
| 4,984,685 | 1/1991 | Douglas . | |
| 5,103,977 | 4/1992 | Douglas . | |

*Primary Examiner*—Joseph Man-Fu Moy
*Attorney, Agent, or Firm*—Brady, O'Boyle & Gates

[57] ABSTRACT

A child drowning protection guard for an open head, plastic industrial container to prevent a toddling child from toppling head first into the container containing a liquid. The guard is provided by a tapered tube integral with the bottom wall of the container and extending upwardly from the bottom wall, through the surface of the liquid, a distance at least one-half the height of the container, and having an effective diameter at the top so that the radial space between the tube and the inner side wall of the container is dimensioned to be less than the diameter of the head of a typical toddling child. The tube is hollow so that a plurality of empty containers can be stacked in nested relationship, and the side wall of the tube can be corrugated or fluted to conserve on the amount of volume taken from the container by the placement of the tube therein.

12 Claims, 4 Drawing Sheets

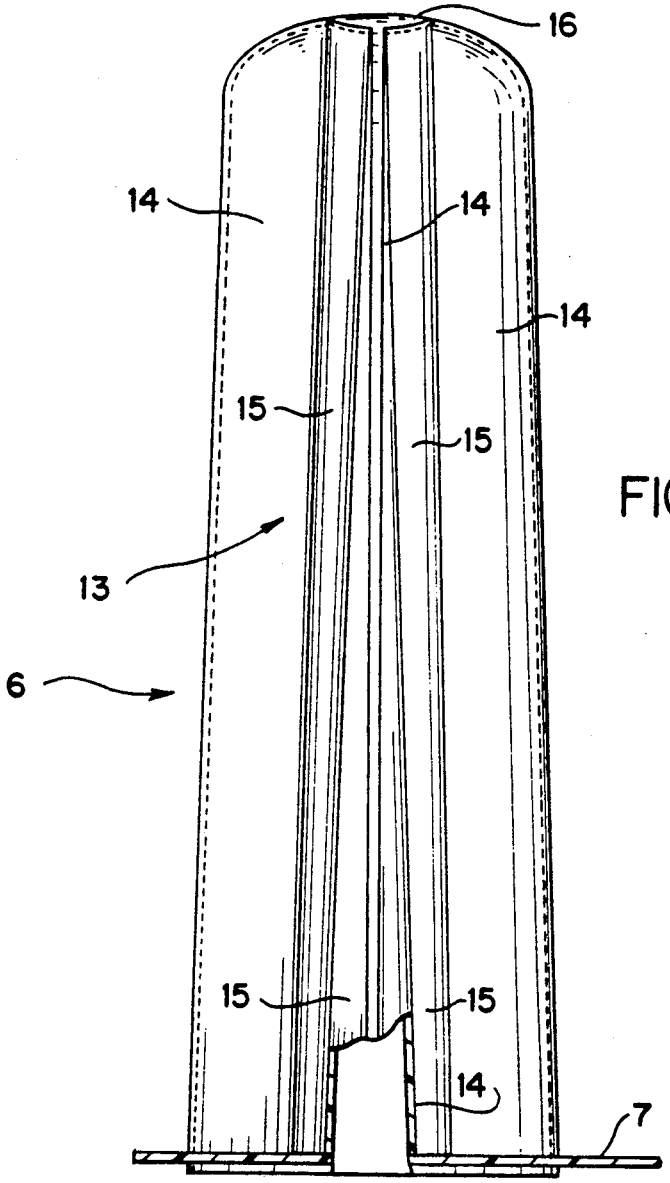
FIG. 7
FIG. 8
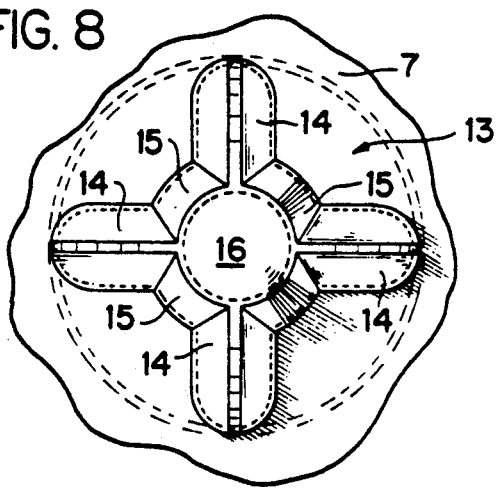
FIG. 9
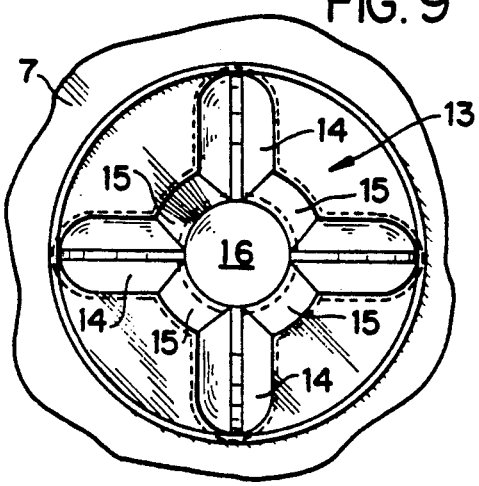

CHILD DROWNING PROTECTING GUARD FOR AN OPEN HEAD NESTABLE CONTAINER

BACKGROUND OF THE INVENTION

The Coalition For Container Safety has reported that in the past five years more than one hundred small children have drowned after falling into buckets containing water or other liquids, according to the U.S. Consumer Product Safety Commission.

These buckets most often are five-gallon, open head, 14 inch straight-sided, plastic industrial containers, generally used to transport bulk or commercial quantities of products including food, paint, cleaning solutions and construction materials. When emptied of their original contents, these containers are often used in the home for containing cleaning fluid while household chores are being performed. If the bucket, filled with just a few gallons of water, is left unattended with a typical eight month to fifteen month old curious child nearby, the child is liable to crawl to the bucket and pull himself or herself up by the rim, or toddle to the bucket. Standing at the bucket, the child can then reach into the bucket to play in the water, or with his or her reflection in the water. If a toy or other object is dropped into the water, the child is likely to lean forward into the bucket in an attempt to retrieve the toy resulting in the child toppling head first into the bucket. Because much of the weight is distributed in the top portion of the child's body, and the 14 inch bucket is about half the height of the typical, top heavy child, with the rim of the bucket just below the child's center of gravity and the weight of the bucket of water being more than the weight of the child, the bucket does not tip over and the child cannot otherwise work free when he or she falls into the bucket head first.

In Applicant's continued pursuit to answer the call of the U.S. Consumer Product Safety Commission for child resistant products, he has now extended his inventive expertise in child resistant closures for medicine bottles, child resistant closures for industrial containers, and child resistant cigarette lighters to the industrial container, or bucket, of the present invention, having a guard to prevent a child from toppling head first into the bucket containing water or other liquid to thereby protect the child from drowning.

SUMMARY OF THE INVENTION

The open head, nestable container with integral child drowning protection guard of the present invention comprises, essentially, an open head, closed bottom, straight-sided, plastic container having, at the center of the bottom, an upwardly tapering hollow tube having a closed upper end. The tube extends upwardly from the bottom wall of the container a distance at least one-half the height of the container, whereby when a child leans over the container rim, the child's head will abut the top of the tube, which prevents the child from reaching any further into the container, thereby precluding the child from toppling head first into the water or liquid in the container. The tubes are hollow, so that a plurality of the containers can be stacked in a nested relationship, and the tubes have an effective top diameter such that the radial space between the tube and the sidewall of the container is less than the diameter of the head of a typical eight month to twelve month old child. The closed upper end of the tube can be rounded to eliminate any sharp corners, and the side wall of the tube can be fluted in various shapes or corrugated to conserve on the amount of volume taken from the container by the placement of the tube therein.

BRIEF DESCRIPTION OF THE DRAWINGS

FIG. 7 is a fragmentary side elevational view of yet another embodiment of the tubular guard partly in longitudinal cross-section;

FIG. 8 is a top plan view of the tubular guard shown in FIG. 7; and

FIG. 9 is a bottom plan view of the tubular guard shown in FIG. 7.

DESCRIPTION OF THE PREFERRED EMBODIMENTS

Figure 1:
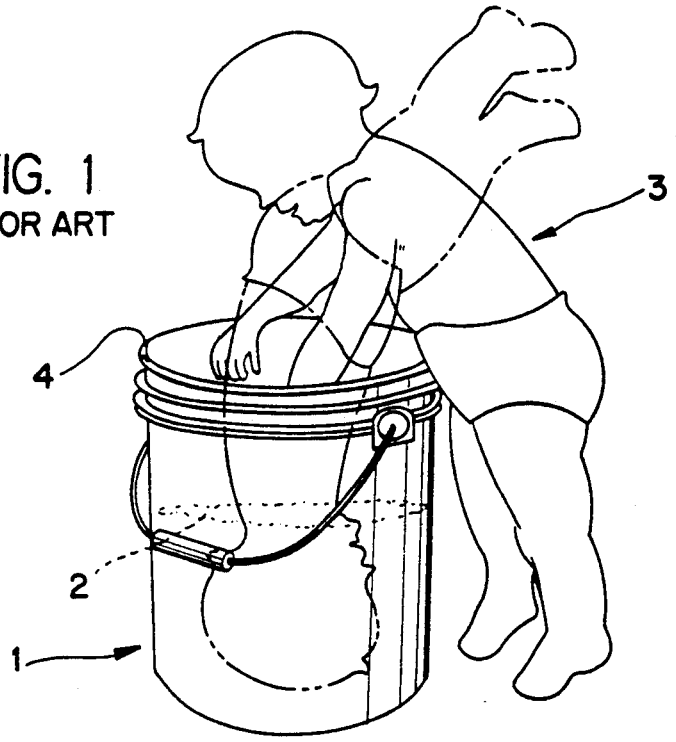
FIG. 1 PRIOR ART
FIG. 1 is a perspective view of a prior art industrial container partially filled with a liquid and showing a child reaching and toppling into the container.

Referring to the drawings and more particularly to FIG. 1, a conventional five-gallon open head, typically 14 inches high, straight-sided, plastic industrial container or bucket 1 is shown partially filled with a liquid such as water 2. When such a container is left unattended, a curious eight month to fifteen month old child 3 is liable to crawl to the bucket 1 and pull himself or herself up by the rim 4, and while standing alongside the bucket the child can reach into the bucket to play in the water 2. If a toy or other object is dropped into the water, the child 3 is likely to lean forward into the bucket 1 in an attempt to retrieve the toy, resulting in the child 3 toppling head first into the bucket 1, as shown in phantom lines in FIG. 1.

Because much of the weight is distributed in the top portion of the child's body and the 14 inch high bucket 1 is about half the height, 28 inches, of the typical, top heavy, child 3, with the bucket rim 4 being just below the child's center of gravity and the weight of the bucket of water being more than the weight of the child 3, the bucket 1 does not tip over and the child cannot otherwise work free when he or she falls head first into the bucket, resulting in possible drowning of the child.

Figure 2:
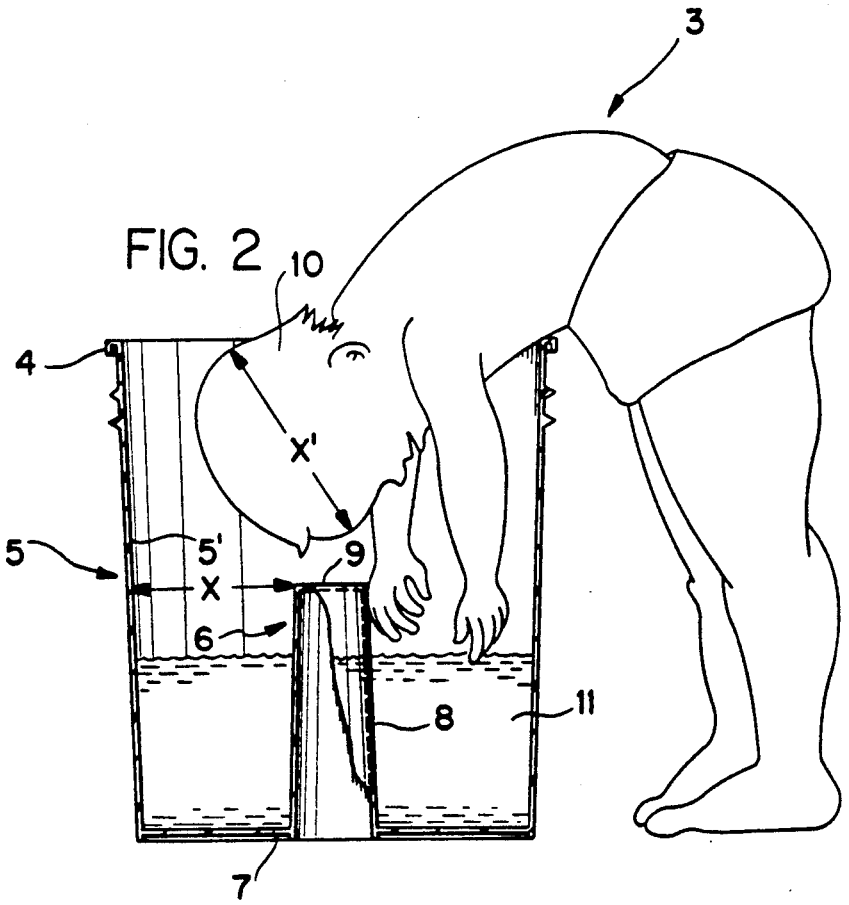
FIG. 2 is a fragmentary, sectional side elevational view of the container of the present invention showing a child reaching into the container.
Figure 3:
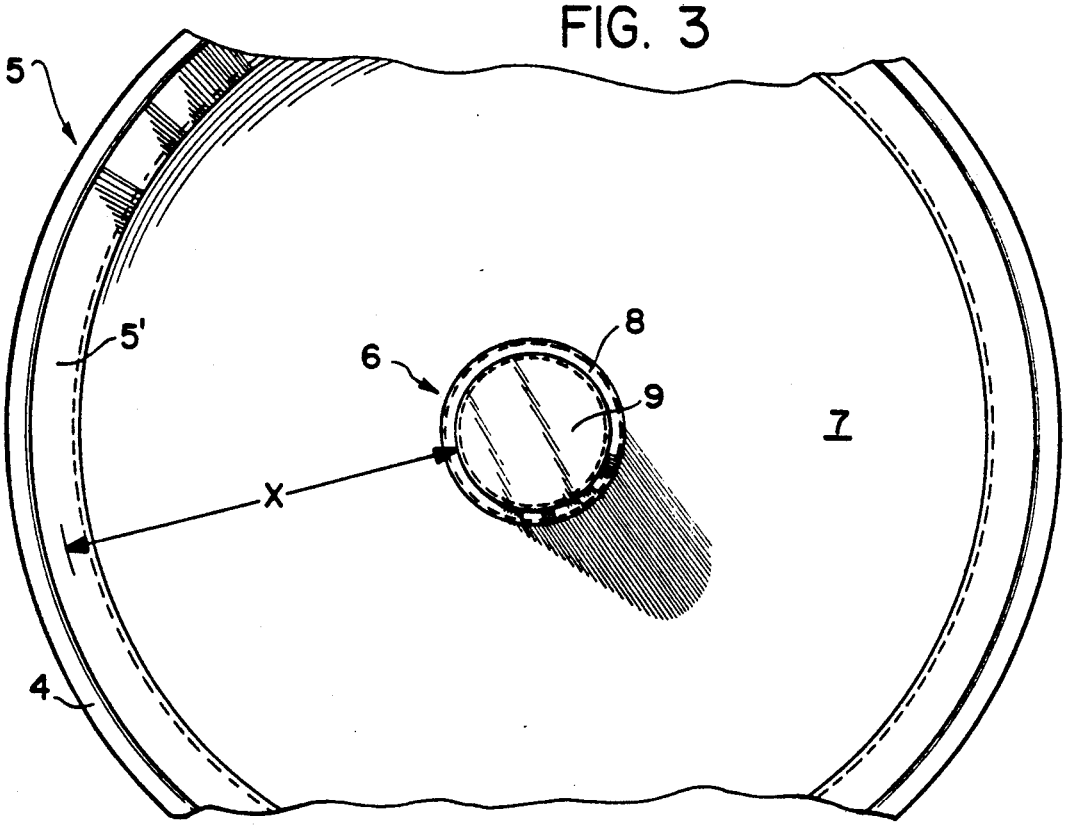
FIG. 3 is an enlarged, fragmentary top plan view of the container shown in FIG. 2.
Figure 4:
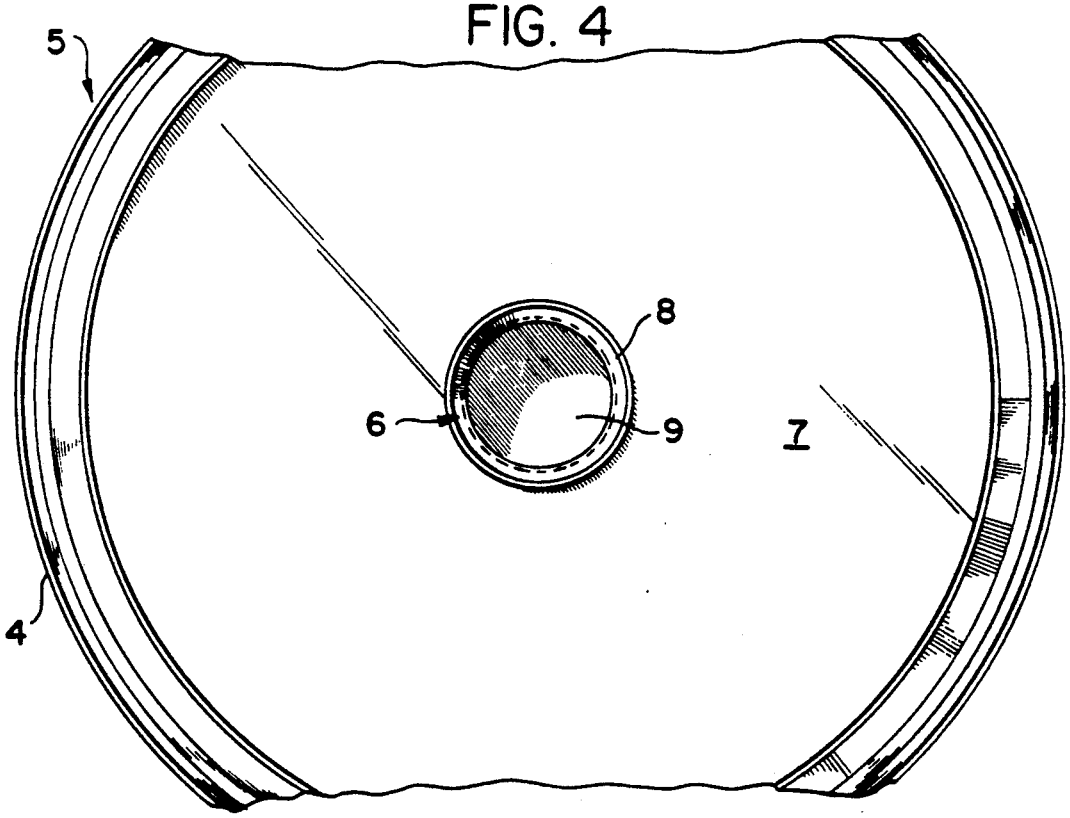
FIG. 4 is an enlarged, fragmentary bottom plan view of the container shown in FIG. 2.

To prevent the child 3 from falling head first into the bucket of water, the container of the present invention has been devised, as shown in FIGS. 2 to 4. The container 5 is the conventional industrial container of the type shown in FIG. 1; however, a guard 6 is molded integral with the bottom wall 7 of the container. The guard 6 comprises an upwardly tapering, hollow tube 8 having a closed upper end 9. The tube 8 is positioned at the center of the container bottom wall 7 and extends upwardly therefrom a distance at least one-half the height of the container. The radial space x defined by the outer surface of the tube 8 and the inner surface 5' of the container side wall is dimensioned to be less than the diameter x' (4" to 6") of the head 10 of a typical eight month to fifteen month old child, whereby the child's head 10 cannot become stuck between the guard 6 and the inner wall 5' of the container 5.

By the construction and arrangement of the container 5 and associated guard 6, when the child 3 leans over the container rim, the child's head will abut the top wall 9 of the tube 8 which prevents the child from reaching any further into the container, thereby preventing the child from toppling head first into the water 11 or liquid in the container 5.

The invention pertains to open head containers of all sizes, for example, three-and-one-half gallons, six gallons, etc., and is described herein in connection with a five-gallon size container, only since that is the most widely used container size. Different manufacturers manufacture their five-gallon size containers with different dimensions, so it is difficult to be specific concerning the dimensions of the guard tube 8. Typically, five gallon open head containers, for example, have a height in the range of 13" to 14", an inside diameter at the bottom in the range of 10¼" to 10½", an inside diameter at the top in the range of 11½" to 12", and an inside diameter at the mid-point of the container height in the range of 10⅞" to 11¼". Generally speaking, and by way of example only, the guard 6 of the invention would preferably have a height for such containers of at least 6½" to 7", a diameter at the base in the range of 3¼" to 3⅜", and a diameter at the closed upper end 9 in the range of 3" to 3⅛", so that the radial space x is less than the diameter of the head 10 of a typical child as hereinbefore described.

Figure 5:
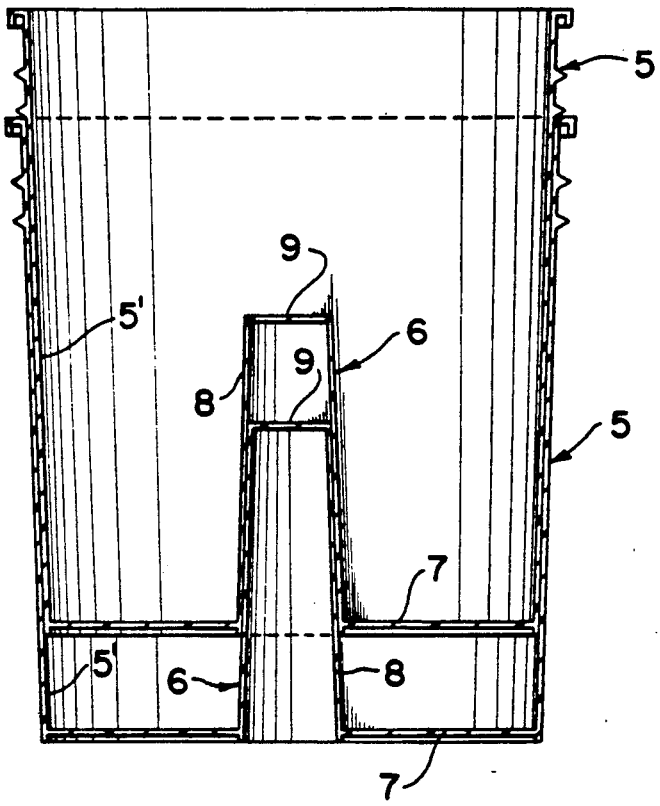
FIG. 5 is a sectional, side elevational view of a plurality of the containers of FIG. 2, shown in a stacked, nested relationship.

As will be seen in FIG. 5, the tubes 8 are hollow so that empty containers 5 can be stacked in a nested relationship as shown.

Figure 6:
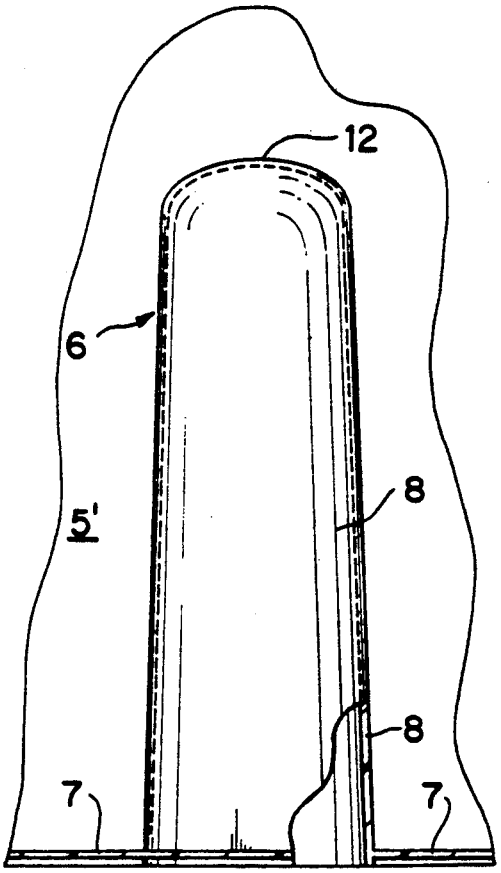
FIG. 6 is a fragmentary, side elevational view showing another embodiment of the tubular guard.

FIG. 6 shows another embodiment of the guard 6, wherein the top wall 12 of the tube 8 is curvilinear to eliminate any sharp corners, to thereby prevent any cuts to the child's head 10.

While the side wall of each of the tubes 8 shown in FIGS. 1 to 6 is continuous, FIGS. 7 to 9 show another embodiment of the guard 6 wherein the side wall of the tube is fluted or corrugated as at 13 to conserve on the amount of the volume taken from the container 5 by the placement of the guard 6 therein. While the illustrated tube surface comprises four circumferentially spaced, radially outwardly extending hollow, tapered lobes 14 interconnected at their inner portions by an equal number of arcuate sections 15, any number of lobes can be employed and any desired cross-sectional configuration of the fluted or corrugated surface can be used, such as, but not limited to a hollow, tapered, five-pointed star. The top of the guard 6 is closed by the curved top wall 16 into which the curved tops of the plural lobes 14 merge, as shown in FIG. 7. Since the lobes or points of the flutes, and since the corrugations, are hollow and tapered from their base to their top, a plurality of empty containers can be stacked in a nested relationship for shipment, in the same manner as shown in FIG. 5.

The terms and expression which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. A child drowning protection guard for an open head nestable container comprising, an open head, closed bottom, straight sided plastic container, containing a volume of liquid, and a member secured to the bottom of the container and extending upwardly from the container bottom and through the liquid surface a distance at least one-half the height of the container, said member being positioned at the center of the container bottom and being spaced radially inwardly from the side wall of the container, the radial space between the member and the side wall of the container being dimensioned to be less than the diameter of the head of a typical eight month to twelve month old child, whereby when a child leans into the open container the child's head abuts the member to prevent the child from reaching any further into the container, thereby preventing the child from toppling head first into the liquid in the container.

2. A child drowning protection guard according claim 1, wherein the member comprises an upwardly tapering tube having a closed upper end, a side wall and a lower end portion integral with the container bottom.

3. A child drowning protection guard according to claim 2, wherein the tube is hollow, whereby a plurality of empty containers can be stacked in nested relationship.

4. A child drowning protection guard according to claim 2, wherein the closed upper end of the tube is curvilinear to thereby eliminate any sharp corners which might cut the child's head.

5. A child drowning protection guard according to claim 2, wherein the side wall of the tube is formed with a cross-sectional configuration to conserve on the amount of volume taken from the container by the placement of the tube therein.

6. A child drowning protection guard according to claim 5, wherein the side wall of the tube is formed with a fluted configuration.

7. A child drowning protection guard according to claim 5, wherein the side wall of the tube is formed with a corrugated configuration.

8. A child drowning protection guard according to claim 6, in which said fluted configuration comprises a plurality of hollow radial protrusions that are upwardly tapered.

9. A child drowning protection guard for an open head nestable container comprising, an open head, closed bottom, straight sided plastic container, adapted to contain a volume of liquid, and a hollow member integrally connected to the bottom of the container and extending upwardly from the container bottom a distance to at least the medial position of the height of the container, said hollow member having a closed upper end and being positioned at the center of the container bottom and opening through said container bottom, said hollow member being spaced radially inwardly from the side wall of the container and defining a radial space between said closed upper end of said member and the side wall of the container dimensioned to be less than the diameter of the head of a typical eight month to twelve month old child, whereby when a child leans into the open container the child's head abuts the member to prevent the child from reaching any further into the container, thereby preventing the child from toppling head first into liquid which may be in the container.

10. A child drowning protection guard according to claim 9, wherein said hollow member comprises an upwardly tapering tube having a side wall.

11. A child drowning protection guard according to claim 10, wherein the side wall of the tube is formed with a cross-sectional configuration to conserve on the amount of volume taken from the container by the placement of the tube therein.

12. A child drowning protection guard according to claim 11, wherein the side wall of the tube is formed with a fluted configuration.

* * * * *